US007647711B2

(12) United States Patent
McMullin

(10) Patent No.: US 7,647,711 B2
(45) Date of Patent: Jan. 19, 2010

(54) FOOTWEAR CLEAT WITH INWARD TRACTION ELEMENTS

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 677 days.

(21) Appl. No.: 11/387,044

(22) Filed: Mar. 23, 2006

(65) Prior Publication Data

US 2006/0260152 A1 Nov. 23, 2006

Related U.S. Application Data

(60) Provisional application No. 60/664,196, filed on Mar. 23, 2005.

(51) Int. Cl.
*A43B 5/00* (2006.01)

(52) U.S. Cl. ..... 36/134; 36/67 D

(58) Field of Classification Search ..... 36/67 R, 36/67 D, 134

See application file for complete search history.

(56) References Cited

U.S. PATENT DOCUMENTS

| | | | | | |
|---|---|---|---|---|---|
| 2,095,095 | A * | 10/1937 | Howard | 36/59 R |
| 3,063,171 | A | 11/1962 | Hollander | |
| D395,542 | S | 6/1998 | Collins | |
| D401,046 | S | 11/1998 | McMullin | |
| 6,052,923 | A * | 4/2000 | McMullin | 36/127 |
| 6,079,127 | A * | 6/2000 | Nishimura et al. | 36/61 |
| 6,305,104 | B1 * | 10/2001 | McMullin | 36/127 |
| 6,834,445 | B2 * | 12/2004 | McMullin | 36/127 |
| 2004/0010944 | A1 * | 1/2004 | McMullin | 36/127 |
| 2006/0230639 | A1 * | 10/2006 | McMullin | 36/134 |

* cited by examiner

*Primary Examiner*—Marie Patterson
(74) *Attorney, Agent, or Firm*—Edell, Shapiro & Finnan, LLC

(57) ABSTRACT

A cleat includes a hub and dynamic traction elements of the type that resiliently flex upwardly under the load of the weight of a wearer of a shoe. The traction elements are biased to resiliently flex inwardly from the hub periphery while flexing upwardly under the load.

13 Claims, 2 Drawing Sheets

FOOTWEAR CLEAT WITH INWARD TRACTION ELEMENTS

CROSS-REFERENCE TO RELATED APPLICATION

This application claims priority from U.S. Provisional Patent Application Ser. No. 60/664,196 entitled "Footwear Cleat With Inward Traction Elements," filed Mar. 23, 2005. The disclosure of this provisional patent application is incorporated herein by reference in its entirety.

BACKGROUND OF THE INVENTION

1. Field of the Invention

The present invention pertains generally to cleats for use with athletic shoes worn on turf and other surfaces. In particular, the present invention pertains to improvements in the golf cleat disclosed in my prior U.S. Pat. No. 6,023,860 (referred to herein as "my '860 patent").

2. Discussion of the Related Art

In my aforesaid '860 patent there is disclosed a removable cleat for use with an athletic shoe for providing traction to a user on a turf surface without damaging the turf surface, and also providing traction on hard surfaces, carpeting and other flooring without damaging that flooring. That removable cleat comprises a hub having a first or upper side facing the shoe sole and a second or bottom side facing away from the shoe sole. A hub attachment means extends from the first side for attaching the hub to one of the plural attachment means located on or in the shoe sole. Plural traction elements extend outward and downward in cantilevered fashion from the hub periphery, each traction element having a turf-engaging portion projecting away from the bottom side of the hub for engagement with turf blades to provide traction without puncturing turf. The traction element is resiliently deflectably attached to the hub so that the turf-engaging portion deflects upward toward the shoe sole at a location beyond the hub periphery when it encounters a hard surface under load, thereby minimizing wear of the turf-engaging portion of the traction element by the hard surface. The relatively broad and substantially flat outward surface of the traction element tends to trap grass blades against the sole of the shoe to enhance traction. Thus, where the traction elements of the cleat of my aforesaid '860 patent spread open under load, the traction elements of the present invention close toward one another in gripping grass blades to effect the desired traction. Although that cleat is effective to provide traction, the spreading out of the traction elements results in a relatively large area of the shoe sole being dedicated to a single cleat. This limits the number of replaceable cleats and other traction-producing structures that can be used on a shoe sole.

OBJECTS AND SUMMARY OF THE INVENTION

The present invention takes a different approach to providing traction, and in so doing provides a cleat that is more compact in that it occupies less area on the sole of the shoe than is required for the cleat described above. In particular, the traction elements, instead of extending outwardly and downwardly from the periphery of the cleat hub, extend inwardly and downwardly from the hub periphery or a location near the periphery. Since these traction elements are also resiliently deflectably attached to the hub, their turf-engaging portions deflect upward and inward toward the hub near the hub center when encountering a weight load. In this manner the traction elements under load tend to close inwardly, much like the action of a Venus fly trap, to trap grass blades between themselves and against the bottom surface of the hub. In order to effect this function, the inwardly directed traction element must be configured so that its lowermost end (i.e., the end remote from the hub) is inward from the hub periphery and from the root of the traction element (i.e., the proximal end of the traction element) at the interior surface of the traction element. In other words, the distal tip of the traction element is closer than the root to the central longitudinal axis passing perpendicularly through the hub. Otherwise stated, the distal end of the traction element must be positioned inward from the hub periphery when the traction element is unflexed. Merely providing one or more surfaces or segments of the element that extend inwardly will not serve the intended purpose unless the distal end is thusly located.

In the preferred embodiment, each traction element has a concave interior-facing surface and terminates in a distal end surface that faces generally inwardly. All of the distal ends face generally toward a central longitudinal axis of the hub. The bottom-most surface of each traction element is preferably a short flat or planar section of the downward, facing surface of the element and constitutes the initial ground-engaging portion of the element. This ground-engaging bottom-most surface is located closer to the distal end than to the proximal end of the traction element so that the force exerted on the element under load (i.e., under the weight of the wearer) applies a substantial torque to the traction element to effect flexure of the element inward and upward toward the hub center. The ground-engaging surface need not be planar, but instead may be convex or otherwise configured to maximize the deflecting torque applied to the element while distributing the forces applied to the ground so as to thereby minimize possible resulting damage to greens.

The preferred embodiment of the invention as described below has eight substantially identical inwardly oriented traction elements disposed at equal circumferentially spaced locations along the hub and symmetrically about the hub central longitudinal axis (i.e., an axis disposed perpendicularly through the center of the bottom surface of the hub). It is to be understood that the number of traction elements can be changed as desired. Moreover, the principles of the invention apply whether all or only some of the traction elements are directed inwardly, whether the traction elements are equally spaced or not about the hub periphery, whether or not all of the traction elements have the identical configuration, and whether or not the traction elements are symmetrically disposed about the hub axis.

Each traction element may but need not necessarily be strengthened against tearing by connecting webs of the type described and illustrated in my co-pending U.S. patent application Ser. No. 10/915,472, filed Aug. 11, 2004 and entitled "Shoe cleat", the entire disclosure of which is incorporated herein by reference. Such webs are positioned and configured to prevent clogging of the cleat with grass and/or mud in the region between the traction elements and the cleat hub and between the traction elements themselves.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

In accordance with the present invention, traction is provided for athletic activities on turf surfaces by providing an athletic shoe having cleats, each of which has a hub with a plurality of resiliently flexible traction elements extending inwardly and downwardly from the hub. The cleat also preferably includes an attachment member, male or female, such as a threaded stud or shaft or socket or other attachment device, which may be integral with, or removable from, the central hub, for attaching the cleat to a corresponding mating attachment member, such as a threaded or other engagement socket or shaft secured in the sole of an athletic shoe.

Figure 1:
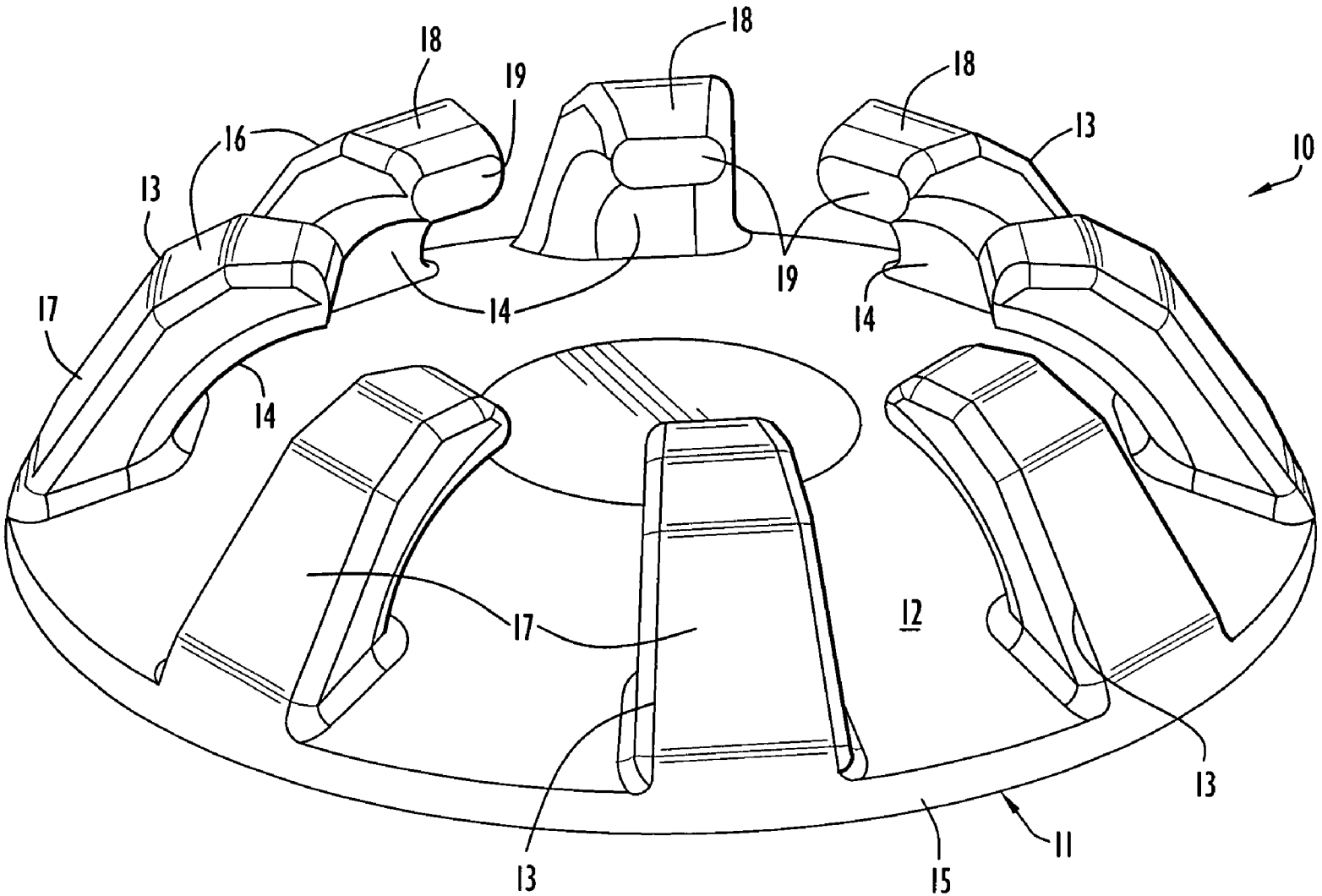
FIG. 1 is a view in perspective of the bottom or traction side of an exemplary shoe cleat in accordance with the present invention.
Figure 2:
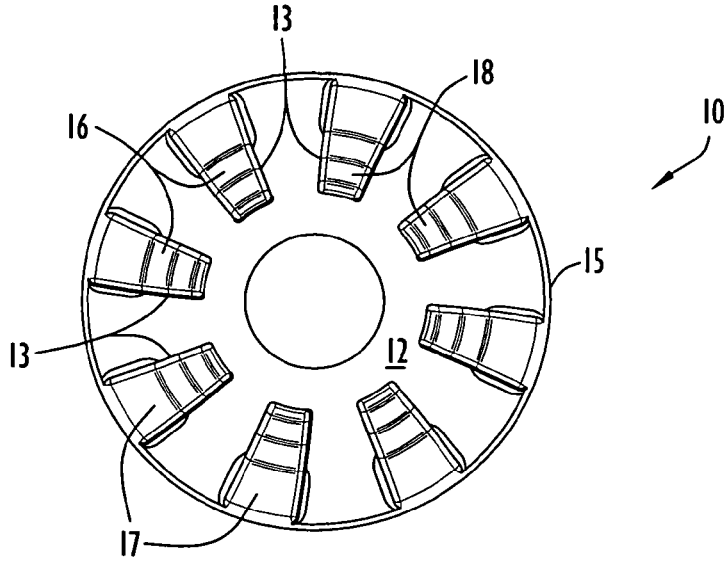
FIG. 2 is a bottom view in plan of the shoe cleat of FIG. 1.
Figure 3:
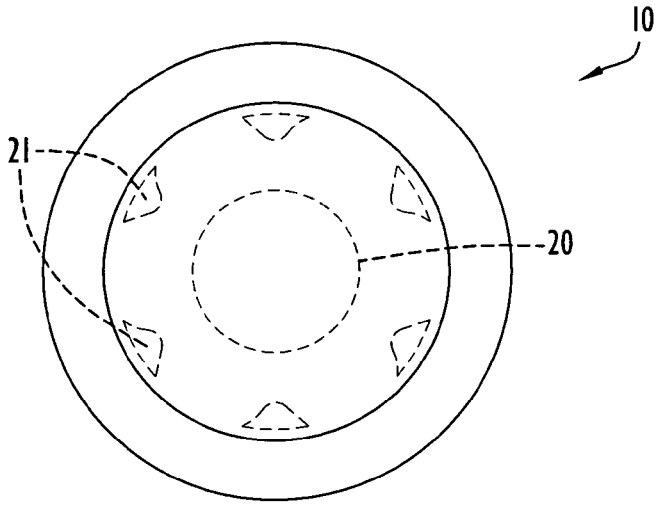
FIG. 3 is a top view in plan of the shoe cleat of FIG. 1.
Figure 4:
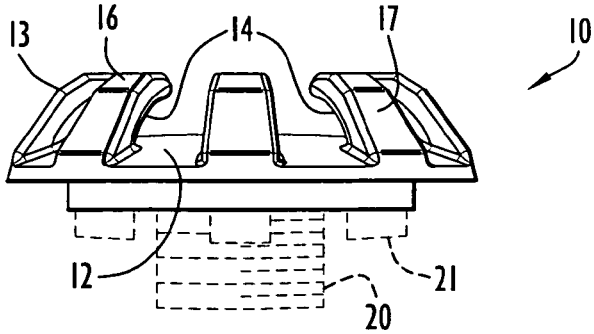
FIG. 4 is a side view in elevation of the shoe cleat of FIG. 1.

Referring to FIGS. 1-4, a cleat 10 has an attachment shaft or connector 20, or the like, which preferably is threaded for attachment to a shoe via one of plural threaded sockets mounted in the shoe outsole or otherwise secured to the shoe in a conventional manner. The particular means for attaching the cleat to a shoe (i.e., the inter-engaging connection components on the cleat and shoe) are not part of the present invention. In that regard it is to be understood that any connection means can be used to connect the cleat of the present invention to a shoe. In addition, the connection means may include a locking mechanism 21 to prevent inadvertent removal of the cleat from the socket. Further, the connection means may be indexable in the sense that the cleat can reside in the socket in a unique (i.e., only one) rotational position. The indexable feature is particularly useful where the traction elements are configured and/or positioned asymmetrically to render the cleat most effective to provide traction when in a particular rotational position. Still further, the connection means may be male or female and adapted to engage a corresponding female or male structure, respectively, mounted in the shoe sole.

In addition to connector or shaft 20, discussed above, each cleat 10 preferably has a hub 11 with a generally convex bottom surface 12 and a top surface from which connector member 20 extends generally perpendicularly. In the preferred embodiment illustrated in the drawings, hub 11 is substantially circular; however, the hub can have virtually any peripheral configuration. A plurality of spaced traction elements 13 project downwardly and radially inward from the periphery 15, or from close to the periphery, of hub 11. In the illustrated embodiment there are eight identical traction elements which are angularly spaced at equal intervals along hub periphery 15. As shown in the drawings, traction elements 13 are arms cantilevered inward from the hub periphery. Both the interiorly-facing surface and the exteriorly-facing surface of the traction element extend both inwardly and downwardly relative to the hub. The interiorly-facing longitudinal surface 14 of each traction element is substantially continuous and arcuate. The radius of curvature of the longitudinal arc of surface 14 is typically much smaller than the radius of curvature at the hub periphery which is smaller than the radius of curvature of the convex bottom surface 12 of the hub. The outer or outwardly facing surface of each traction element 13 also extends inwardly and downwardly and is divided into discrete sections but may also be continuous and arcuate. The sections forming the outer surface preferably include a proximal section 17 encompassing most of its length and extending distally from the hub. Proceeding distally from arm section 17, the outer surface of the illustrated traction element includes two shorter inward bend sections 16 and 18, the more distal of which, section 18, resides in a plane substantially perpendicular to the central longitudinal axis of the hub. Sections 18 of the plural traction elements all reside in that common plane which is the lowermost part of cleat 10 and defines the initial turf-engaging surface of the traction elements 13 and cleat 10. A feature of the invention resides in the fact that section 18 of each traction element is disposed at a location radially inward of the traction element root (i.e., the intersection of the traction element with the hub). Distally of turf-engaging surface 18, the outer surface of each traction element forms part of the distal end of the element which extends further inward and slightly upward and terminates in a substantially planar terminal surface 19.

It should be noted that the traction elements 13 need not be arcuate along their inward-facing surfaces or segmented along their outward-facing surfaces. For example, both surfaces can be formed as single straight section appropriately angled downwardly and inward toward the cleat axis. Traction elements 13 are preferably joined at their proximal ends deflectably to hub 11, in a cantilevered manner, so that traction elements 13 can resiliently deflect when their ground-engaging outer surface portions 18 encounter a hard surface (such as a paved surface or even a closely cropped golf green or other closely cropped grass surface) under the weight of the wearer of the shoe. Where, as in the preferred embodiment, the traction element 13 includes defined arm and leg segments, preferably at least the arm is resiliently deflectably mounted on hub 11. Most preferably, the entire traction element, but at least section 17, is made from a resilient material such as polyurethane or other resiliently flexible elastomeric polymer. The turf-engaging portions can be made from the same material as arms 17, provided that the material is sufficiently durable; or at least a portion such as surface 18, can be made from a more abrasion-resistant material such as a filled elastomer. When turf-engaging portions 18 are made from a different material than sections 17, these parts can be co-molded. Similarly, hub 11 may be made from the same material as some or all of the traction element portions, or could be a different material. Preferably, however, cleat 10 is made entirely from a single material such as polyurethane or other flexible, durable elastomer, from which it is preferably made by injection molding.

The preferred traction elements 13 provide traction on turf by the inter-engagement of interior arcuate surfaces 14 with the individual grass blades without penetrating or puncturing the crown of any individual grass plant of the turf, and without penetrating or puncturing the soil. The traction elements extend down between the grass blades and preferably are restrained by the grass blades themselves against lateral motion, thereby providing lateral traction. Because of the deflectable connection of the traction elements, they can be allowed to protrude into the grass blades while nevertheless avoiding or minimizing damage to the turf. In addition, the resilient flexure of the traction elements under load (i.e., weight of the shoe wearer) causes the traction elements to flex inwardly from the hub periphery and upward to trap grass blades against the convex surface 12 of the hub to thereby provide traction by resisting relative movement between the cleat and the trapped grass.

The preferred embodiment of the invention is a symmetrical cleat in which traction elements 13 are equally spaced about a circular hub. It will be appreciated, however, that the principles of the invention apply to other types of cleats, including those in which the hub is asymmetrical and/or the traction elements are asymmetrically disposed. In particular, the hub may have any suitable geometric configuration consistent with the principles described herein, including, without limitation, irregularly shaped configurations, or regular circular, elliptical, rectangular, triangular or multi-sided configurations, etc. Likewise, the traction elements can be of different types on the same cleat and/or can be positioned asymmetrically to achieve desired traction functions.

As noted above, the means for attaching the cleat to a shoe, or a socket or a male connector in a shoe, does not constitute part of the invention in that any attachment and/or locking means can be utilized without departing from the principles of the invention.

Although it is preferred that the entire cleat be molded integrally from the same polymer material, it is within the scope of the invention to otherwise form the cleat such that separate parts are separately formed and later joined, and/or forming different parts of the cleat form different materials in order to optimize the intended functions of those parts.

The features of the invention apply most optimally when used with cleats in which the traction elements freely resiliently flex under load, as described. Such traction elements are referred to herein as dynamic by virtue of their movement under load. It should be noted that the principles nevertheless apply for cleats with static traction elements or other cleats. For example, whether or not the traction elements flex, the inwardly angled traction elements as described herein function to provide traction by engaging grass blades disposed between the traction elements and between the traction elements and the hub. The selection of a specific cleat design, including the selected number of each type of traction element, as well as a selected orientation of the traction elements in sets or arrays on the hub, depends upon specific applications in which the cleat will be utilized and the type, amount and direction of traction that is desired for that application.

The bottom convex surface 12 of the hub serves to absorb most of the weight of the wearer of the shoe, particularly on hard surfaces, as the traction elements flex to minimize wear on the traction elements.

The cleat is preferably constructed of any one or more suitable plastic materials, including, without limitation, polycarbonates, polyamides (e.g., nylon), polyurethanes, natural or synthetic rubbers (e.g., styrene-butadiene), and other elastomeric polyolefins.

While the bottom surfaces 18 of the traction elements are depicted as being generally planar in the drawings, it is noted that these surfaces may have other configurations, for example a rounded and slightly convex configuration, depending upon the particular application, so as to enhance inward deflection of elements 13 as they resiliently flex under the weight of the wearer of the cleated shoe against a ground surface. In this regard, the angle formed between section 17 of the traction element and the hub can be any acute angle that will essentially bias the flexure direction inwardly from the hub periphery under load. In other words, an obtuse angle would bias flexure outwardly, whereas a right angle would provide no directional bias and leave the direction of flexure indeterminate; neither of these would be satisfactory. The degree of bias required will depend on the particular application and will control the magnitude of the acute angle. In general the preferred range is between 35° and 80°, but that should not be construed as limiting the scope of the invention.

As noted hereinabove, it is also a feature of the invention that the lowermost portion of the traction element is disposed radially inward of the inward-most part of the root or proximal end of the traction element (i.e., at the intersection of the traction element and the hub). When cantilevered inwardly in this manner, the traction element will be biased to flex inwardly and upward under load. It is also highly advantageous if the outermost part of the traction element is located inward of the periphery of the hub to assure a proper inward deflection bias.

The cleat may be removably or non-removably secured to a shoe sole. Any suitable cleat connector may be utilized to removably secure the cleat to the shoe in any selected orientation. The cleat connector may include a single connecting member or a series of connecting members that combine to secure the cleat to the shoe sole. It is to be understood that, when a cleat connector includes two or more connecting members, the central axis of the cleat connector is disposed at the geometric center defined by the combination of connecting members forming the cleat connector. Any number of cleats may be combined in any number of suitable orientations to provide enhanced traction for a particular user and/or a particular activity.

It will be understood that, although the features of the present invention have particular utility for cleats used with golf shoes, the principles of the invention apply to cleats used for any sport or purpose in which traction between a shoe and the ground is necessary or desired.

Having described preferred embodiments of shoe cleats with improved traction, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of traction elements each having a root at its proximal end secured to the bottom surface of said hub and a tip at its distal end remote from said hub, at least one of said traction elements being flexible and extending at an angle from the hub both downwardly from the bottom surface and inwardly toward said axis such that said tip is closer than said root to said longitudinal axis when said one traction element is unflexed; and a cleat connector member provided in an upper surface of the hub facing oppositely of the bottom surface, wherein said connector is securable to a shoe connector member.

2. The cleat of claim 1, wherein said at least one traction element is a dynamic traction element extending from the hub in a direction away from the exposed bottom surface of the hub and inwardly toward said axis, the dynamic traction element being configured to resiliently deflect toward the hub and the longitudinal axis when the shoe sole is forced against the ground surface.

3. The cleat of claim 2, wherein said dynamic traction element has an outwardly facing surface with a proximal section forming an acute angle with the hub.

4. The cleat of claim 3, wherein said acute angle is in a range between 35° and 80° to inwardly bias flexure of the dynamic traction element under load.

5. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of traction elements, at least one of said traction elements extending at an angle from the hub both downwardly from the bottom surface and inwardly toward said axis; and a cleat connector member provided in an upper surface of the hub facing oppositely of the bottom surface, wherein said connector is securable to a shoe connector member;

wherein said dynamic traction element has a proximal end joined to said hub at an intersection, and a distal end at which the traction element is most remote from the hub, and wherein the distal end is closer to said axis than every point along said intersection.

6. A cleat securable to the sole of a shoe for providing traction for the shoe on a around surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of traction elements, at least one of said traction elements extending at an angle from the hub both downwardly from the bottom surface and inwardly toward said axis; and a cleat connector member provided in an upper surface of the hub facing oppositely of the bottom surface, wherein said connector is securable to a shoe connector member;

wherein said dynamic traction element has a distal end at which the traction element is most remote from the hub, wherein the distal end is closer to said axis than the remainder of the dynamic traction element, and wherein the distal end extends slightly upward toward said hub.

7. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of resiliently flexible dynamic traction elements, each having a root at its proximal end secured to the bottom surface of said hub and a tip at its distal end remote from said hub, and each cantilevered at an angle from the hub both downwardly from the bottom surface and inwardly toward said axis such that when unflexed said tip is closer than said root to said longitudinal axis to bias the traction elements to flex both radially inwardly and upward toward the hub under the weight of a wearer of the shoe; and a cleat connector member provided in an upper surface of the hub facing oppositely of the bottom surface, wherein said connector is securable to a shoe connector member.

8. The cleat of claim 7, wherein each dynamic traction element has an outwardly facing surface with a proximal section forming an acute angle with the hub.

9. The cleat of claim 8, wherein said acute angle is in a range between 35° and 80°.

10. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of resiliently flexible dynamic traction elements each cantilevered at an angle from the hub both downwardly from the bottom surface and inwardly toward said axis to bias the traction elements to flex both radially inwardly and upward toward the hub under the weight of a wearer of the shoe; and a cleat connector member provided in an upper surface of the hub facing oppositely of the bottom surface, wherein said connector is securable to a shoe connector member wherein each dynamic traction element has a proximal end joined to said hub at an intersection, and a distal end at which the traction element is most remote from the hub, and wherein the distal end is closer to said axis than every point along said intersection.

11. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of resiliently flexible dynamic traction elements each cantilevered at an angle from the hub both downwardly from the bottom surface and inwardly toward said axis to bias the traction elements to flex both radially inwardly and upward toward the hub under the weight of a wearer of the shoe; and a cleat connector member provided in an upper surface of the hub facing oppositely of the bottom surface, wherein said connector is securable to a shoe connector member;

wherein each dynamic traction element has a distal end at which the traction element is most remote from the hub, wherein the distal end is closer to said axis than the remainder of the dynamic traction element, and wherein the distal end extends slightly upward toward said hub.

12. The cleat of claim 11, wherein each dynamic traction element includes in interiorly facing longitudinally arcuate surface having a radius of curvature which is smaller than the radius of the periphery of said hub.

13. The cleat of claim 12, wherein the bottom surface of said hub is convex and has a radius of curvature greater than the radius of curvature of the hub periphery.

* * * * *